US006543735B1

(12) United States Patent
Haynes et al.

(10) Patent No.: US 6,543,735 B1
(45) Date of Patent: Apr. 8, 2003

(54) SMOKE DETECTOR SHIELD

(75) Inventors: John Robert Haynes, Groton, MA (US); Lawrence G. Stanley, Templeton, MA (US)

(73) Assignee: ADT Services AG, Schaffhausen (CH)

( * ) Notice: Subject to any disclaimer, the term of this patent is extended or adjusted under 35 U.S.C. 154(b) by 0 days.

(21) Appl. No.: 09/665,253

(22) Filed: Sep. 19, 2000

Related U.S. Application Data

(60) Provisional application No. 60/156,258, filed on Sep. 27, 1999.

(51) Int. Cl.[7] ..... A47F 5/00

(52) U.S. Cl. ..... 248/300; 248/309.1

(58) Field of Search ..... 248/300, 674, 248/309.1, 309.2, 317, 342, 343, 344, 909; 211/86.01, 87.01, 90.01, 72, 13.1; 312/245, 246, 223.1; D6/553, 559; D8/364, 373; 52/27

(56) References Cited

U.S. PATENT DOCUMENTS 1,859,221 A * 5/1932 Richard
2,166,523 A * 7/1939 Gaebel
3,247,332 A * 4/1966 McHugh
3,492,056 A * 1/1970 Murray
4,071,217 A * 1/1978 Kongelka ..... 248/309.1
4,255,001 A * 3/1981 Frishman ..... 312/245
4,429,928 A * 2/1984 Sullivan ..... 312/245
4,630,794 A * 12/1986 Ross ..... 248/309.1
4,796,850 A * 1/1989 Aramaki ..... 248/674
5,109,646 A * 5/1992 Colonias et al. ..... 248/300
5,201,486 A * 4/1993 Holbrook ..... 248/309.1
5,555,694 A * 9/1996 Commins ..... 248/300
5,570,865 A * 11/1996 Godfrey ..... 248/222.11
5,613,660 A * 3/1997 Wyatt ..... 248/300
5,792,994 A * 8/1998 Akahane ..... 248/309.1
5,813,641 A * 9/1998 Baldwin ..... 248/300
5,868,477 A * 2/1999 Dacarie ..... 312/245
5,927,666 A * 7/1999 Barkan ..... 248/300
D421,714 S * 3/2000 Moscovitch et al. ..... D8/373
6,061,989 A * 5/2000 Trivedi et al. ..... 248/300
6,065,728 A * 5/2000 Spradlin ..... 248/309.1
6,068,228 A * 5/2000 Kobayashi et al. ..... 248/309.1

* cited by examiner

*Primary Examiner*—Daniel P. Stodola
*Assistant Examiner*—Jennifer E. Novosad
(74) *Attorney, Agent, or Firm*—Hamilton, Brook, Smith & Reynolds, P.C.

(57) ABSTRACT

A shield for a wall mounted smoke detector guard or enclosure prevents looped items from being hung on the shield and the enclosure. The shield includes a mounting surface for mounting to a wall. A downwardly sloping surface structure extends from the mounting surface for extending above the top surface of the enclosure. The downwardly sloping surface structure has sufficient slope and length for preventing items from being hung on the shield and the enclosure while at the same time providing a direct smoke flow path therepast to the top surface of the enclosure.

34 Claims, 2 Drawing Sheets

SMOKE DETECTOR SHIELD

RELATED APPLICATION(S)

This application claims the benefit of provisional application serial No. 60/156,258, filed Sep. 27, 1999, the entire teachings of which are incorporated herein by reference.

BACKGROUND

Fire detection systems in prisons often incorporate wall mounted smoke detectors in each cell. To prevent tampering with the smoke detectors by inmates, the smoke detectors are generally covered by enclosures known as detector guards which are mounted to the wall around the smoke detectors. The detector guard is generally a box-like enclosure made of a heavy-duty perforated metal sheet or mesh. When mounted to the wall, the detector guard projects out from the wall, creating a risk that an inmate could injure or kill himself/herself by hanging from a belt or piece of cloth looped over the top surface of the detector guard.

SUMMARY

The present invention provides a shield for a wall mounted smoke detector guard, or enclosure, which prevents looped items from being hung on the shield and the enclosure. The enclosure has a top surface formed of screen material. The shield includes a mounting surface or portion for mounting to a wall. A downwardly sloping surface structure extends from the mounting surface for extending above the top surface of the enclosure. The downwardly sloping surface structure has sufficient slope and length for preventing items from being hung on the shield and the enclosure while at the same time providing a direct smoke flow path therepast to the top surface of the enclosure.

In preferred embodiments, the downwardly sloping surface structure includes two downwardly angled ribs extending from opposite ends of the mounting surface. The shield is preferably formed of sheet metal with the ribs being bent at right angles relative to the mounting surface. The mounting surface is sized for mounting above the top surface of the smoke detector enclosure and for positioning the ribs against opposite sides of the enclosure for preventing the insertion of items therebetween. The ribs are sized to extend at least as far as the front surface of the enclosure and have rear ends extending below the mounting surface that are separated from the mounting surface by slots. The slots enable the ribs to be bent during manufacturing such that the rear ends may extend close to the wall when mounted for preventing the insertion of items therebetween.

The present invention also provides an enclosure system for a wall mounted smoke detector which includes an enclosure for surrounding and protecting the smoke detector. The enclosure is mounted to a wall and has a top surface formed of screen material. A shield extends above the top surface of the enclosure. The shield has a downwardly sloping surface structure that has sufficient slope and length for preventing items from being hung on the shield and the enclosure while at the same time providing a direct smoke flow path therepast to the top surface of the enclosure.

The present invention shield provides a simple and effective solution for preventing looped items from being hung from a smoke detector guard that does not interfere with the flow of smoke to the smoke detector in the event of a fire. As a result, the present invention shield does not compromise the ability of the smoke detector to detect fires.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
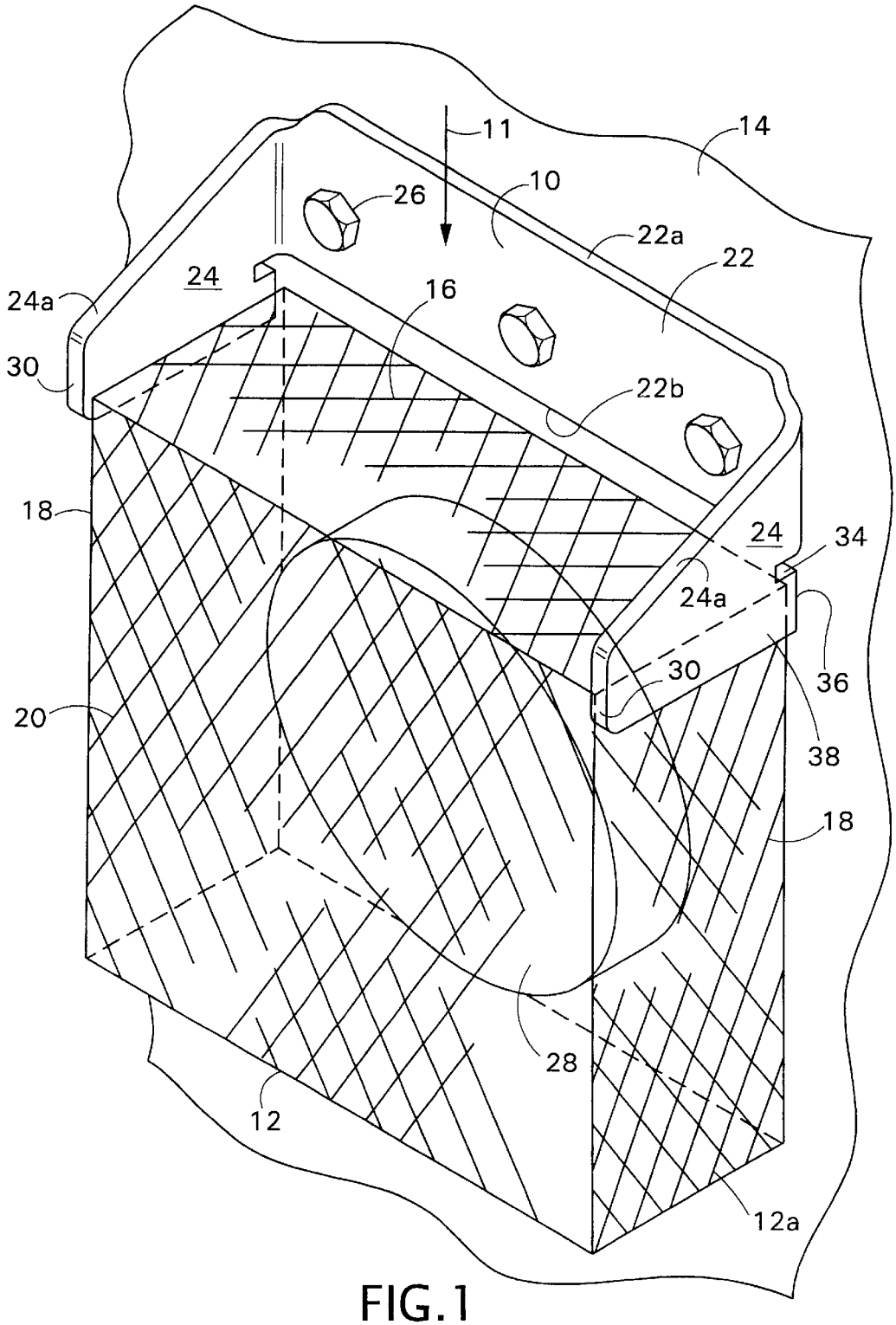
FIG. 1 is a perspective view of an embodiment of the present invention smoke detector shield mounted to the wall and positioned above an enclosure surrounding a smoke detector.
Figure 2:
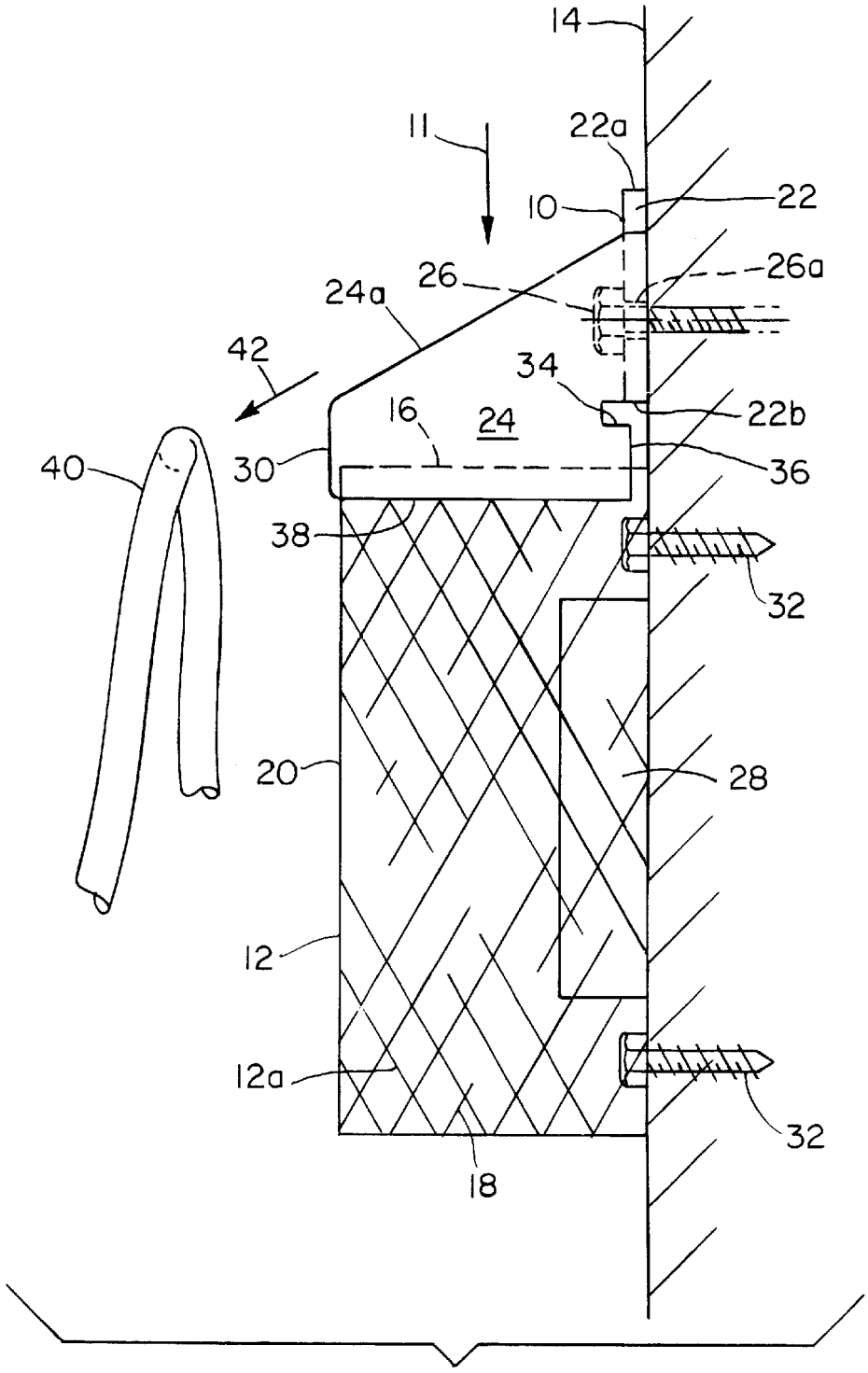
FIG. 2 is a side view of the smoke detector shield positioned above the enclosure.

A description of preferred embodiments of the invention follows. Referring to FIGS. 1 and 2, smoke detector 28 is mounted to a wall 14 and is protected from damage or tampering by a smoke detector guard or enclosure 12. The enclosure 12 is secured to wall 14 by screws 32 (FIG. 2). Access to screws 32 is provided by a hinged door on enclosure 12 which is secured with tamper proof fasteners. Enclosure 12 is formed of a metallic mesh or screen 12*a* which has openings of sufficient size and number to allow smoke to flow therethrough into the enclosure 12 in the event of a fire so that smoke can be detected by smoke detector 28.

Smoke detector shield 10 is mounted to the wall 14 above enclosure 12 for preventing looped items 40 (FIG. 2) such as belts, loops of clothing, etc. from being hung on enclosure 12 so that a person cannot cause harm or death to himself/herself by hanging. Shield 10 has a planar central mounting plate or portion 22 which is mounted to the wall 14 above the top 16 of enclosure 12 by a series of bolts or screws 26. Two thin vertical ribs or fins 24 extend outwardly or forwardly relative to the wall 14 from opposite ends of mounting plate 22 and are positioned on opposite sides 18 of enclosure 12. Each rib 24 has a smooth downwardly sloping or angled upper surface 24*a* which extends from the mounting plate 22 and terminates at a front end 30 approximately at the front 20 of enclosure 12.

In use, any attempt to hang a looped item 40 (FIG. 2) on the enclosure 12 or shield 10 results in the looped item 40 sliding off the shield 10 without retention thereon. The angled surfaces 24*a* of ribs 24 extend at an angle steep enough to cause looped items 40 that are looped over shield 10 to slide down ribs 24 along the downwardly angled surfaces 24*a* in the direction of arrow 42 and off shield 10 without engagement with enclosure 12. In addition, the mounting plate 22 is too narrow to retain a looped item 40 thereon and any attempt to do so results in the looped item 40 sliding down ribs 24. Thus, looped items 40 cannot be retained on the top surfaces of shield 10 or enclosure 12. The ribs 24 are positioned closely to enclosure 12 and wall 14 to prevent the insertion of a looped item 40 therebetween. This prevents the hanging of any looped items 40 by insertion within spaces between the shield 10, the enclosure 12 and the wall 14.

Shield 10 is able to prevent looped items 40 from being hung on shield 10 and enclosure 12 while at the same time providing a direct open vertical path 11 for smoke to flow downwardly past shield 10 and into the enclosure 12 through the top 16 of enclosure 12. In a fire situation, smoke billows down from the ceiling and travels vertically downwardly along the wall 14. In order for the fire to be detected by smoke detector 28, the smoke must first penetrate the enclosure 12 through the top 16. By making the mounting plate 22 relatively thin so that the mounting plate 22 protrudes only slightly from the wall 14, and by positioning the ribs 24 beyond opposite sides 18 of enclosure 12, smoke traveling downwardly along wall 14 flows unimpeded to the top 16 and into enclosure 12 through flow path 11 for quick detection by smoke detector 28. The ribs 24 may also act as guides for directing the smoke into the top 16 of enclosure 12. The smoke is able to easily penetrate the screen 12*a* at the top 16 of enclosure 12 for quick detection by smoke detector 28 because the top 16 is perpendicular to the flow direction of the smoke. Directing smoke through the top 16 of enclosure 12 in a perpendicular manner allows the smoke to penetrate screen 12*a* the most quickly because the effective size of the openings in the screen 12*a* are at their largest from a perpendicular direction. If the smoke were to penetrate the screen 12*a* at an angle, the effective size of the openings become smaller and the penetration rate of the smoke through screen 12*a* decreases. In addition, an angled screen 12*a* may cause some smoke to be deflected.

A more detailed description of the shield 10 now follows. Shield 10 is preferably formed from a single piece of sheet metal that has a thickness sufficient to make shield 10 rigid enough to prevent a person from bending the ribs 24 by hand, for example, 12–16 gauge sheet metal. The ribs 24 are bent at right angles relative to mounting plate 22 and are vertically oriented parallel to each other when shield 10 is mounted to wall 14. Ribs 24 are sufficiently spaced apart from each other so that ribs 24 closely or tightly fit against the sides 18 of enclosure 12. The bottoms 38 of the ribs 24 extend slightly below the top 16 of enclosure 12 to overlap the sides 18 to prevent the insertion of looped items 40 therebetween. The ribs 24 are preferably solid which prevents the insertion of looped items 40 through the ribs 24. The angled upper surfaces 24*a* are preferably smooth to maximize the sliding effect. The front ends 30 of ribs 24 preferably extend at least as far as the front 20 of enclosure 12 to prevent any engagement of looped items 40 with the top 16 of enclosure 12. Alternatively, the front ends 30 may extend slightly short of the front 20 such that the region of enclosure 12 extending beyond the front ends 30 is too skinny to retain a looped item 40. Typically, shield 10 is about 3 inches high and 9½ inches wide with ribs 24 extending from mounting plate 22 about 3 inches. The angled or slanted surfaces 24*a* of ribs 24 are preferably at a 30° angle but may be at a steeper or shallower angle depending upon the situation at hand. Additionally, surfaces 24*a* may be curved in a downward slope instead of being slanted. The mounting plate 22 has a series of holes 26*a* therethrough which allows securement to wall 14 by bolts 26. Typically, three bolts 26, as shown, is sufficient. The top 22*a* of mounting plate 22 may extend slightly higher than surfaces 24*a* of ribs 24 as shown.

The rear ends 36 of ribs 24 below mounting plate 22 extend close to wall 14 to prevent a looped item 40 from being inserted between ribs 24 and wall 14. Slots 34 formed between the bottom 22*b* of mounting plate 22 and the rear ends 36 of ribs 24 allow ribs 24 to be bent forwardly relative to mounting plate 22 in a manner where the rear ends 36 extend rearwardly past the front surface of mounting plate 22. The rear ends 36 extend more rearwardly toward wall 14 than is possible without slots 34.

In other embodiments of the present invention, shield 10 may be part of enclosure 12 or mounted thereto instead of being mounted directly to wall 14. In addition, shield 10 may be molded instead of being bent from sheet metal. If shield 10 is molded, slots 34 may be omitted since rear ends 36 may be extended rearwardly without requiring slots 34. Furthermore, intermediate ribs 24 positioned between those shown in the figures may be included. In such a case, a direct smoke flow path 11 to the top 16 of enclosure 12 may still be provided. Furthermore, the present invention shield may be formed in two pieces, where two separate ribs 24 are individually mounted to the wall or enclosure 12. This may allow the present invention shield to be fitted to enclosures of varying size.

While this invention has been particularly shown and described with references to preferred embodiments thereof, it will be understood by those skilled in the art that various changes in form and details may be made therein without departing from the scope of the invention encompassed by the appended claims.

For example, although the present invention shield 10 has been described primarily for use in jail or prison cells, shield 10 may also be employed in other institutions such as mental institutions and drug rehabilitation centers. In addition, although ribs 24 are preferably vertically oriented, alternatively, the upper portions of ribs 24 may be angled slightly inwardly towards each other. Such inward angling may allow shield 10 to be more tightly fitted against the sides 18 of enclosure 12. The front ends 30 of ribs 24 may also be angled slightly towards each other for the same purpose. Furthermore, although two ribs 24 positioned at the sides 18 of enclosure are preferred, alternatively, a single central rib 24 may be employed. Finally, the present invention shield may also be employed for shielding enclosures other than smoke detector enclosures.

What is claimed is:

1. A shield for a wall mounted smoke detector enclosure formed of screen material, the shield being formed of sheet metal and comprising:

a mounting surface for mounting to a wall; and a downwardly sloping surface structure extending from the mounting surface for extending above the enclosure, the downwardly sloping surface structure having sufficient slope and length for preventing items from being hung on the shield and the enclosure while at the same time providing a direct smoke flow path therepast to the enclosure, the downwardly sloping surface structure comprising two downwardly sloping ribs bent from the mounting surface, the ribs having rear ends extending below the mounting surface that are separated from the mounting surface by slots, the slots enabling the ribs to be bent during manufacturing such that the rear ends may extend close to the wall when mounted for preventing the insertion of items therebetween.

2. The shield of claim 1 in which the downwardly sloping ribs are downwardly angled and extend from opposite ends of the mounting surface.

3. The shield of claim 2 in which the ribs are bent at right angles relative to the mounting surface.

4. A shield formed of sheet metal for a wall mounted smoke detector enclosure formed of screen material, the shield comprising:

a mounting surface for mounting to a wall; and two ribs bent from opposite ends of the mounting surface to project forwardly relative to the mounting surface, the ribs each having a downwardly sloping surface for extending above the enclosure, the downwardly sloping surfaces having sufficient slope and length for preventing items from being hung on the shield and the enclosure while at the same time providing a direct smoke flow path therepast to the enclosure, the ribs having rear ends extending below the mounting surface that are separated from the mounting surface by slots, the slots enabling the ribs to be bent during manufacturing such that the rear ends may extend close to the wall when mounted for preventing the insertion of items therebetween.

5. The shield of claim 4 in which the ribs are downwardly angled.

6. The shield of claim 5 in which the ribs are bent at right angles relative to the mounting surface.

7. An enclosure system for a wall mounted smoke detector comprising:

an enclosure for surrounding and protecting the smoke detector, the enclosure adapted to be mounted to a wall and having a top surface formed of screen material;

a shield extending above the top surface of the enclosure, the shield having a downwardly sloping surface structure that has sufficient slope and length for preventing items from being hung on the shield and the enclosure while at the same time providing a direct smoke flow path therepast to the top surface of the enclosure.

8. The system of claim 7 in which the downwardly sloping surface structure comprises two downwardly angled ribs.

9. The system of claim 8 in which the shield further comprises a mounting surface for mounting to the wall, the ribs extending from opposite ends of the mounting surface.

10. The system of claim 9 in which the shield is formed of sheet metal, the ribs being bent at right angles relative to the mounting surface.

11. The system of claim 10 in which the mounting surface is sized for mounting above the top surface of the smoke detector enclosure and positioning the ribs against opposite sides of the enclosure for preventing the insertion of items therebetween.

12. The system of claim 11 in which the ribs are sized to extend at least as far as the front surface of the enclosure.

13. The system of claim 12 in which the ribs have rear ends extending below the mounting surface that are separated from the mounting surface by slots, the slots enabling the ribs to be bent during manufacturing such that the rear ends may extend close to the wall when mounted for preventing the insertion of items therebetween.

14. A shield for a wall mounted smoke detector enclosure formed of screen material, the shield comprising a downwardly sloping surface structure for extending above the enclosure, the downwardly sloping surface structure having sufficient slope and length for preventing items from being hung on the shield and the enclosure while at the same time providing a direct smoke flow path therepast to the enclosure, the downwardly sloping surface structure comprising two downwardly sloping ribs.

15. A shield and wall mounted enclosure system comprising:

an enclosure having front and top surfaces; and a shield comprising:

a mounting surface for mounting to the wall;

a downwardly sloping surface structure extending from the mounting surface for positioning above the top surface of the enclosure, the downwardly sloping surface comprising two downwardly sloping ribs having sufficient slope and length for preventing items from being hung on the shield and the enclosure.

16. A wall mounted smoke detector system comprising:

a smoke detector;

an enclosure for surrounding and protecting the smoke detector, the enclosure capable of being mounted to a wall and having a top surface formed of screen material; and a shield extending above the top surface of the enclosure, the shield having a downwardly sloping surface structure that has sufficient slope and length for preventing items from being hung on the shield and the enclosure while at the same time providing a direct smoke flow path therepast to the top surface of the enclosure.

17. A method of preventing items from being hung on a wall mounted smoke detector enclosure, the enclosure having a top surface formed of screen material, the method comprising the steps of:

securing a mounting surface of a shield to a wall; and providing the shield with a downwardly sloping surface structure extending from the mounting surface of the shield above the top surface of the enclosure, the downwardly sloping surface structure having sufficient slope and length for preventing items from being hung on the shield and the enclosure while at the same time providing a direct smoke flow path therepast to the top surface of the enclosure.

18. The method of claim 17 further comprising the step of providing the downwardly sloping surface structure with two downwardly angled ribs extending from opposite ends of the mounting surface.

19. The method of claim 18 in which the shield is formed from sheet metal, the method further comprising the step of bending the ribs at right angles relative to the mounting surface.

20. The method of claim 19 further comprising the step of sizing the mounting surface for enabling mounting above the top surface of the smoke detector enclosure and for positioning the ribs against opposite sides of the enclosure for preventing the insertion of items therebetween.

21. The method of claim 20 in which the enclosure has a front surface, the method further comprising the step of sizing the ribs to extend at least as far as the front surface of the enclosure.

22. The method of claim 21 further comprising the step of separating rear ends of the ribs from the mounting surface by slots, the slots enabling the ribs to be bent during manufacturing such that the rear ends may extend close to the wall when mounted for preventing the insertion of items therebetween.

23. A method of preventing items from being hung on a wall mounted smoke detector enclosure, the enclosure having a top surface formed of screen material, the method comprising the steps of:

securing a mounting surface of a shield to a wall, the shield being formed of sheet metal; and providing the shield with two ribs bent from opposite ends of the mounting surface to project forwardly relative to the mounting surface, the ribs each having a downwardly sloping surface for extending above the top surface of the enclosure, the downwardly sloping surfaces having sufficient slope and length for preventing items from being hung on the shield and the enclosure while at the same time providing a direct smoke flow path therepast to the top surface of the enclosure.

24. The method of claim 23 further comprising the step of downwardly angling the ribs.

25. The method of claim 24 further comprising the step of bending the ribs at right angles relative to the mounting surface.

26. The method of claim 25 further comprising the step of sizing the mounting surface for enabling mounting above the top surface of the smoke detector enclosure and for positioning the ribs against opposite sides of the enclosure for preventing the insertion of items therebetween.

27. The method of claim 26 in which the enclosure has a front surface, the method further comprising the step of sizing the ribs to extend at least as far as the front surface of the enclosure.

28. The method of claim 27 further comprising the step of separating rear ends of the ribs from the mounting surface by slots, the slots enabling the ribs to be bent during manufacturing such that the rear ends may extend close to the wall when mounted for preventing the insertion of items therebetween.

29. A method of preventing items from being hung on a wall mounted smoke detector enclosure, the enclosure having a top surface formed of screen material, the method comprising the step of providing a downwardly sloping surface structure above the top surface of the enclosure, the downwardly sloping surface structure having sufficient slope and length for preventing items from being hung on the downwardly sloping surface structure and the enclosure while at the same time providing a direct smoke flow path therepast to the top surface of the enclosure.

30. A shield for a wall mounted smoke detector enclosure formed of screen material, the shield being formed of sheet metal and comprising:

a mounting surface for mounting to a wall; and a downwardly sloping surface structure extending from the mounting surface for extending above the enclosure, the downwardly sloping surface structure having sufficient slope and length for preventing items from being hung on the shield and the enclosure while at the same time providing a direct smoke flow path therepast to the enclosure, the downwardly sloping structure comprising two downwardly angled ribs extending from opposite ends of the mounting surface, the ribs being bent at right angles relative to the mounting surface and having rear ends extending below the mounting surface that are separated from the mounting surface by slots, the slots enabling the ribs to be bent during manufacturing such that the rear ends may extend close to the wall when mounted for preventing the insertion of items therebetween.

31. A shield formed of sheet metal for a wall mounted smoke detector enclosure formed of screen material, the shield comprising:

a mounting surface for mounting to a wall; and two downwardly angled ribs bent from opposite ends of the mounting surface to project forwardly at right angles relative to the mounting surface, the ribs each having a downwardly sloping surface for extending above the enclosure, the downwardly sloping surfaces having sufficient slope and length for preventing items from being hung on the shield and the enclosure while at the same time providing a direct smoke flow path therepast to the enclosure, the ribs having rear ends extending below the mounting surface that are separated from the mounting surface by slots, the slots enabling the ribs to be bent during manufacturing such that the rear ends may extend close to the wall when mounted for preventing the insertion of items therebetween.

32. An enclosure system for a wall mounted smoke detector comprising:

an enclosure for surrounding and protecting the smoke detector, the enclosure adapted to be mounted to a wall and having front and top surfaces formed of screen material; and a shield formed of sheet metal extending above the top surface of the enclosure, the shield having a mounting surface for mounting to the wall and a downwardly sloping surface structure that has sufficient slope and length for preventing items from being hung on the shield and the enclosure while at the same time providing a direct smoke flow path therepast to the top surface of the enclosure, the downwardly sloping surface structure comprising two downwardly angled ribs extending from opposite ends of the mounting surface and bent at right angles relative to the mounting surface, the mounting surface being sized for mounting above the top surface of the smoke detector enclosure and positioning the ribs against opposite sides of the enclosure for preventing the insertion of items therebetween, the ribs being sized to extend at least as far as the front surface of the enclosure and having rear ends extending below the mounting surface that are separated from the mounting surface by slots, the slots enabling the ribs to be bent during manufacturing such that the rear ends may extend close to the wall when mounted for preventing the insertion of items therebetween.

33. A method of preventing items from being hung on a wall mounted smoke detector enclosure, the enclosure having front and top surfaces formed of screen material, the method comprising the steps of:

securing a mounting surface of a shield to a wall, the shield being formed of sheet metal; and providing the shield with a downwardly sloping surface structure extending from the mounting surface of the shield above the top surface of the enclosure, the downwardly sloping surface structure having sufficient slope and length for preventing items from being hung on the shield and the enclosure while at the same time providing a direct smoke flow path therepast to the top surface of the enclosure, the downwardly sloping surface structure comprising two downwardly angled ribs extending from opposite ends of the mounting structure and bent at right angles relative to the mounting surface, the mounting surface being sized to enable mounting above the top surface of the smoke detector enclosure and for positioning the ribs against opposite sides of the enclosure for preventing the insertion of items therebetween, the ribs being sized to extend at least as far as the front surface of the enclosure and having rear ends that are separated from the mounting surface by slots, the slots enabling the ribs to be bent during manufacturing such that the rear ends may extend close to the wall when mounted for preventing the insertion of items therebetween.

34. A method of preventing items from being hung on a wall mounted smoke detector enclosure, the enclosure having front and top surfaces formed of screen material, the method comprising the steps of:

securing a mounting surface of a shield to a wall, the shield being formed of sheet metal; and providing the shield with two ribs bent from opposite ends of the mounting surface to project forwardly relative to the mounting surface, the ribs each having a downwardly sloping surface for extending above the top surface of the enclosure, the downwardly sloping surfaces having sufficient slope and length for preventing items from being hung on the shield and the enclosure while at the same time providing a direct smoke flow path therepast to the top surface of the enclosure, the mounting surface being sized for enabling mounting above the top surface of the smoke detector enclosure and for positioning the ribs against opposite sides of the enclosure for preventing the insertion of items therebetween, the ribs being bent at right angles relative to the mounting surface and being sized to extend at least as far as the front surface of the enclosure, the ribs having rear ends separated from the mounting surface by slots, the slots enabling the ribs to be bent during manufacturing such that the rear ends may extend close to the wall when mounted for preventing the insertion of items therebetween.

* * * * *